US010801454B2

(12) United States Patent
Lehmeier et al.

(10) Patent No.: US 10,801,454 B2
(45) Date of Patent: Oct. 13, 2020

(54) METHOD FOR PRODUCING A HIGH-PRESSURE FUEL PUMP

(71) Applicant: Robert Bosch GmbH, Stuttgart (DE)

(72) Inventors: Christoph Lehmeier, Pilsach (DE); Sebastian Bauer, Stuttgart (DE); Tamim Latif, Tokyo (JP); Guenther Schaechtner, Nuremberg (DE); Stefan Brechetsbauer, Schwabach (DE)

(73) Assignee: Robert Bosch GmbH, Stuttgart (DE)

( * ) Notice: Subject to any disclaimer, the term of this patent is extended or adjusted under 35 U.S.C. 154(b) by 50 days.

(21) Appl. No.: 16/315,315

(22) PCT Filed: May 11, 2017

(86) PCT No.: PCT/EP2017/061272
§ 371 (c)(1),
(2) Date: Jan. 4, 2019

(87) PCT Pub. No.: WO2018/007058
PCT Pub. Date: Jan. 11, 2018

(65) Prior Publication Data

US 2019/0309716 A1 Oct. 10, 2019

(30) Foreign Application Priority Data

Jul. 8, 2016 (DE) ..... 10 2016 212 469

(51) Int. Cl.
*F02M 59/48* (2006.01)

(52) U.S. Cl.
CPC ..... *F02M 59/48* (2013.01); *F02M 2200/8084* (2013.01)

(58) Field of Classification Search
CPC ..... F02M 2200/8084; F02M 59/48
See application file for complete search history.

(56) References Cited

U.S. PATENT DOCUMENTS 6,825,436 B1 * 11/2004 Aoyama ..... B23K 11/002 219/117.1
2012/0195780 A1 8/2012 Matsumoto et al.
2015/0352657 A1 12/2015 Echtermeyer et al.

FOREIGN PATENT DOCUMENTS

DE 10 2004 015 440 A1 10/2005
DE 102004015440 A1 * 10/2005 ..... F02M 59/48
(Continued)

OTHER PUBLICATIONS

DE-102004015440-A1 English translation (Year: 2004).*
(Continued)

*Primary Examiner* — Jason L Vaughan
*Assistant Examiner* — Amanda Kreiling
(74) *Attorney, Agent, or Firm* — Maginot, Moore & Back LLP

(57) ABSTRACT

A method for producing a high-pressure fuel pump includes bringing a pump housing into contact with a lower electrode, gripping a pot-shaped cover element using a collet chuck, contacting the cover element with an electrode, bringing the open face of the cover element into contact with the face of the pump housing opposite the lower electrode, centering the cover element on the face of the pump housing opposite the lower electrode, pressing the cover element onto the pump housing in the direction of the lower electrode, and introducing an electrical current from the electrode via the cover element and the pump housing into the lower electrode, such that fusing occurs at the point of contact between the cover element and the pump housing, and such that subsequently the cover element is bonded to the pump housing. The pump housing and the cover element are connected by a peripheral weld seam.

12 Claims, 4 Drawing Sheets

(56) References Cited

FOREIGN PATENT DOCUMENTS

| | | | |
|---|---|---|---|
| DE | 10 2004 047 601 | A1 | 2/2006 |
| DE | 10 2012 205 114 | A1 | 10/2012 |
| EP | 2 055 934 | A2 | 5/2009 |
| EP | 2 989 316 | A1 | 3/2016 |
| JP | H03-226384 | A | 10/1991 |
| JP | H06-031456 | A | 2/1994 |
| JP | 2009-108784 | A | 5/2009 |
| JP | 2012-215164 | A | 11/2012 |
| JP | 2016-118210 | A | 6/2016 |
| WO | 2013/125382 | A1 | 8/2013 |
| WO | 2016056386 | A1 | 4/2016 |

OTHER PUBLICATIONS

International Search Report corresponding to PCT Application No. PCT/EP2017/061272 dated Aug. 29, 2017 (German and English language document) (7 pages).

* cited by examiner

METHOD FOR PRODUCING A HIGH-PRESSURE FUEL PUMP

This application is a 35 U.S.C. § 371 National Stage Application of PCT/EP2017/061272, filed on May 11, 2017, which claims the benefit of priority to Serial No. DE 10 2016 212 469.2, filed on Jul. 8, 2016 in Germany, the disclosures of which are incorporated herein by reference in their entirety.

BACKGROUND

The disclosure relates to a method for producing a high-pressure fuel pump.

Fuel systems for internal combustion engines, in which fuel is pumped from a fuel tank at high pressure into a high-pressure accumulator ("rail") by means of a pre-supply pump and a mechanically driven high-pressure fuel pump, are known on the market. A pressure damper device is customarily arranged on or in a pump housing of such a high-pressure fuel pump. A pressure damper device of this type generally comprises a cover element and a membrane damper which is arranged between cover element and pump housing, is customarily in the form of a gas-filled membrane capsule and is supported on the pump housing via a support element. The pressure damper device here is fluidically connected to a low-pressure region. The pressure damper device serves for damping pressure pulsations in the low-pressure region of the fuel system, said pressure pulsations being caused, for example, by opening and closing operations of valves, for example of an inlet valve, in the high-pressure fuel pump. An integrally bonded connection between the pump housing and the cover element is produced according to the prior art by means of a laser welding process.

SUMMARY

The present disclosure has the advantage that the production of the high-pressure fuel pump is simpler and more reliable and makes it possible to design the pump more advantageously.

In the case of the laser welding process known from the prior art, measures have to be taken to avoid welding splashes inside the pump. By contrast, in the case of the proposed capacitor discharge press-fit welding process (CDPF welding process), only a weld expulsion in the form of a firm burr arises at the connecting point. The CDPF welding process therefore does not result in any additional admission of dirt into the pump. Further measures in this respect can be omitted. Furthermore, the CDPF welding process has a shorter cycle time than the previously known laser welding process.

According to the disclosure, in order to produce a high-pressure fuel pump comprising a pump housing and a cup-shaped cover element, wherein the pump housing the cover element are connected to each other by an encircling weld seam (360°), it is provided that the process steps disclosed herein are carried out.

The method can be further simplified in that the collet chuck and the electrode as a whole are realized by a single tool.

It can furthermore be provided that the inside diameter of the cover element has an excess size in relation to the outside diameter of the pump housing. In association therewith, it can be provided that the cover element is pushed over the pump housing. This reduces the height of the high-pressure fuel pump by the amount of the overpressing. The high-pressure fuel pump thereby becomes more compact as a whole, which is an important requirement for the integration of the high-pressure fuel pump in an internal combustion engine. At the same time, this measure also increases the effective diameter of the cover element. It is thereby possible to provide an enlarged pressure damper between the cover element and the pump housing, which has a positive effect on the functionality of said pressure damper.

It is provided in a development of the process that, during the process, a relative movement between the cover element and the pump housing is detected and evaluated. Additionally or alternatively, a current profile can also be detected and evaluated. In this connection, it is provided in particular that the detected process features are compared with predetermined reference data and it is then determined on the basis of the comparison whether the process has taken place in a defective or error-free manner.

BRIEF DESCRIPTION OF THE DRAWINGS

Further features, application possibilities and advantages of the disclosure emerge from the description below of exemplary embodiments of the disclosure. In the figures.

DETAILED DESCRIPTION

Figure 1:
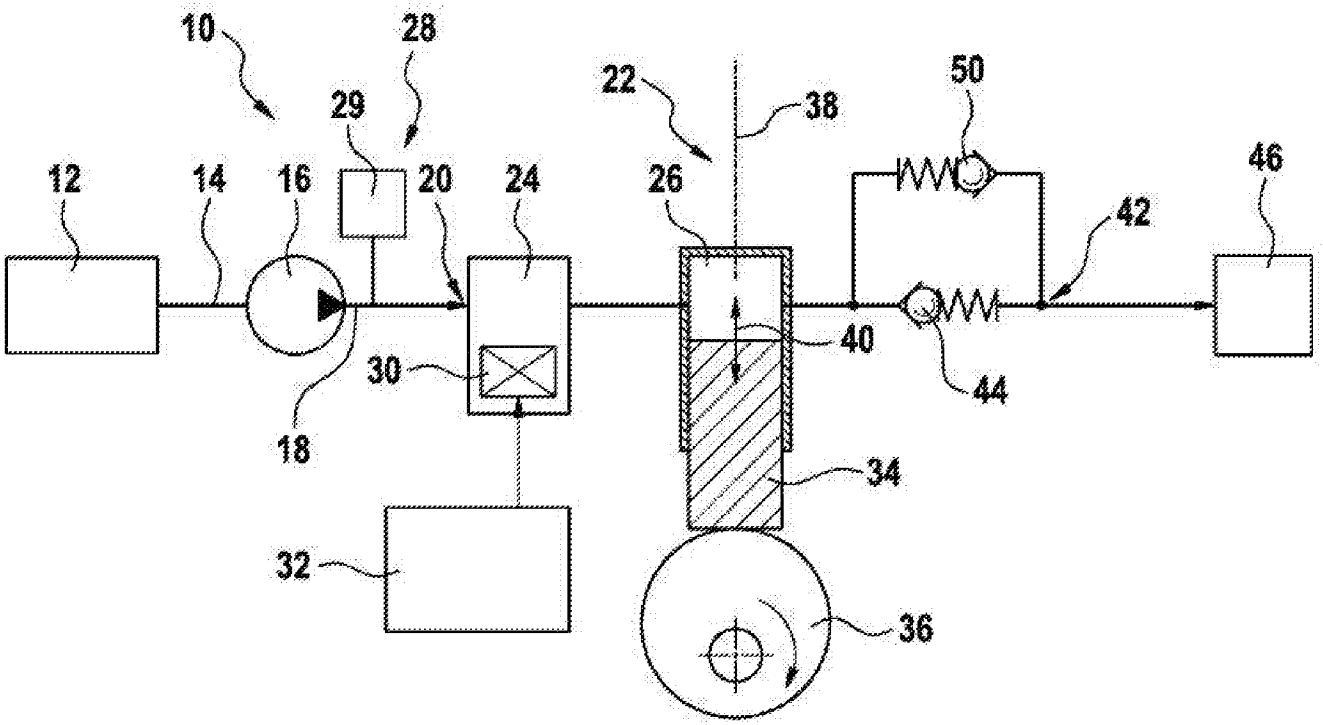
FIG. 1 shows a simplified schematized illustration of a fuel system for an internal combustion engine.

FIG. 1 shows a simplified schematic illustration of a fuel system 10 for an internal combustion engine (not illustrated further). During the operation of the fuel system 10, fuel is supplied from a fuel tank 12 via a suction line 14, by means of a pre-supply pump 16 and a low-pressure line 18 and via an inlet 20 to a high-pressure fuel pump 22 in the form of a piston pump. The inlet 20 has an inlet valve 24 arranged therein, via which a piston chamber 26 can be fluidically connected to a low-pressure region 28 which comprises the pre-supply pump 16, the suction line 14 and the fuel tank 12. Pressure pulsations in the low-pressure region 28 can be damped by means of a pressure damper device 29. The inlet valve 24 can be forcibly opened via an actuating device 30. The actuating device 30 and therefore the inlet valve 24 can be activated via a control unit 32.

A piston 34 of the high-pressure fuel pump 22 can be moved up and down along a piston longitudinal axis 38 by means of a drive 36, which here is in the form of a cam disk, this being illustrated schematically by an arrow having the reference sign 40. An outlet valve 44 is arranged hydraulically between the piston chamber 26 and an outlet connecting branch 42 of the high-pressure fuel pump 22, which outlet valve can open toward a high-pressure accumulator 46 ("rail"). The high-pressure accumulator 46 and the piston chamber 26 can be connected fluidically via a pressure-limiting valve which opens when a limit pressure in the high-pressure accumulator 46 is exceeded.

Figure 2:
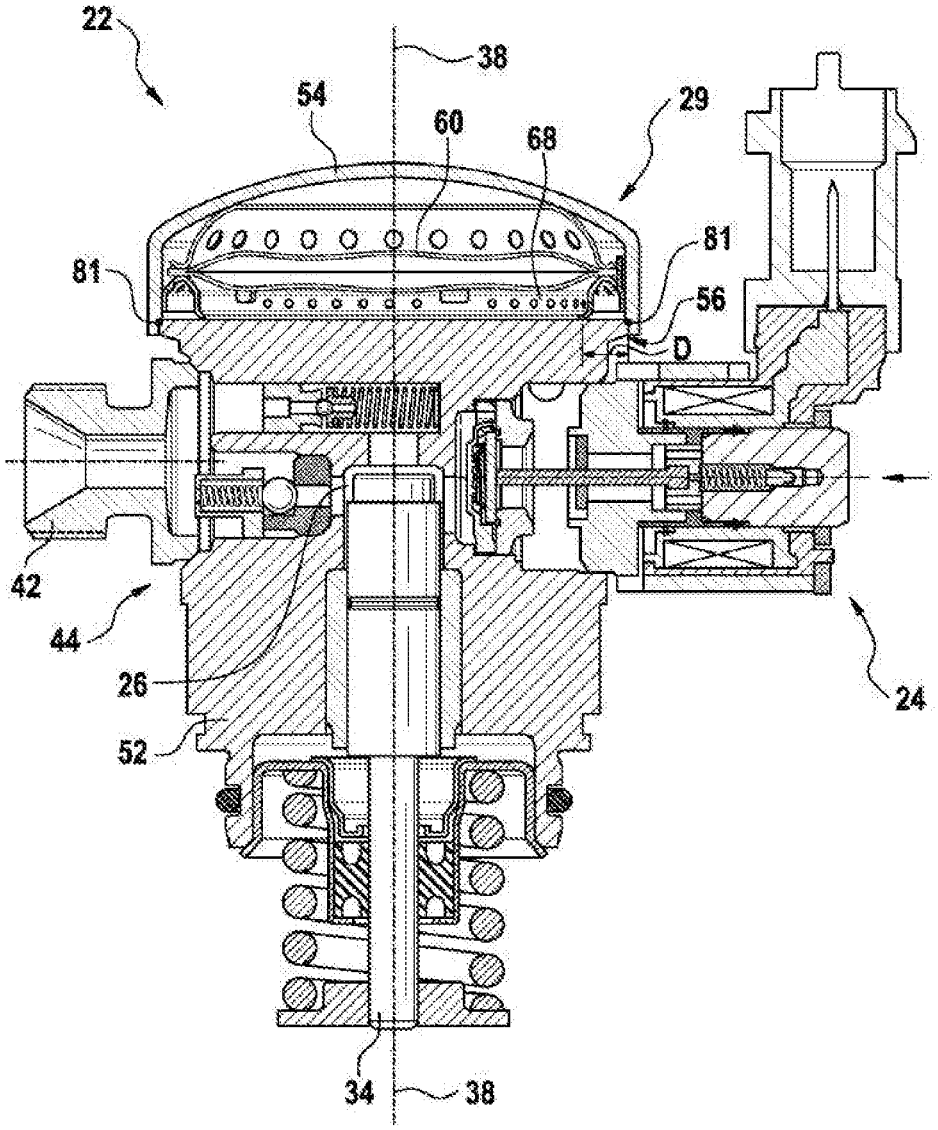
FIG. 2 shows a sectional illustration of a high-pressure fuel pump.

The high-pressure fuel pump 22 is shown in a sectional illustration in FIG. 2. The pressure damper device 29 is arranged in the upper region of the high-pressure fuel pump 22 in the illustration of FIG. 2. The pressure damper device 29 comprises a cup-shaped cover element 54 which is connected to the pump housing 52 in a connecting region 56, specifically here via a CDPF weld seam (capacitor discharge press-fit weld seam).

The connecting region 56 runs around the pump housing in a circumferential direction. A membrane damper capsule 60 is held between the cover element 54 and the pump housing 52 by means of two holding elements.

Figure 3:
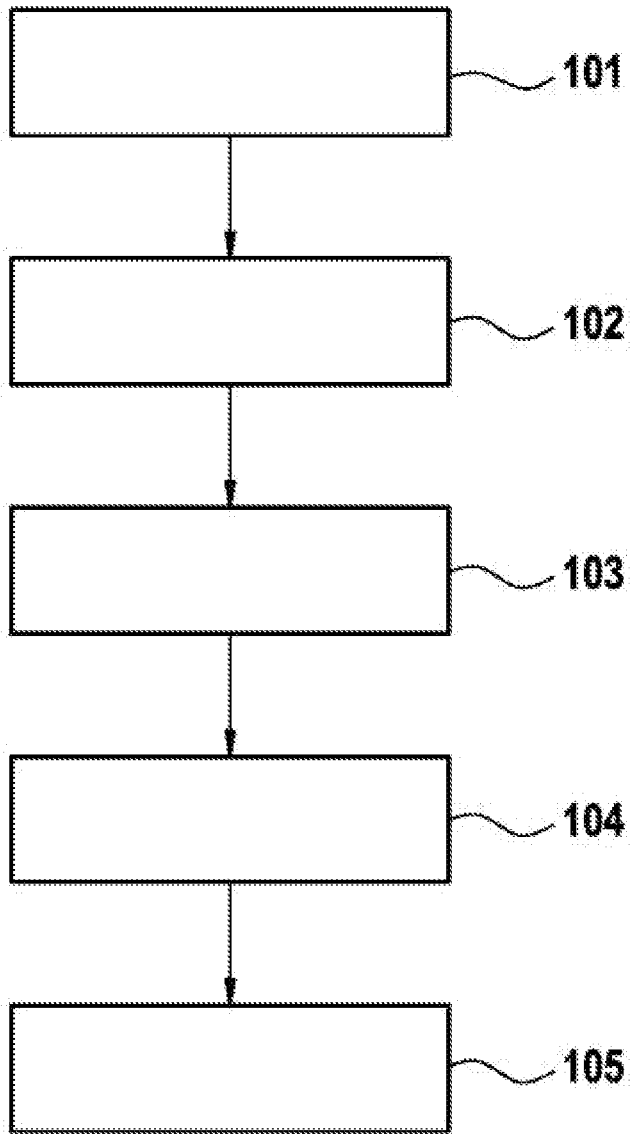
FIG. 3 shows a flow diagram of the production method according to the disclosure.
Figure 4:
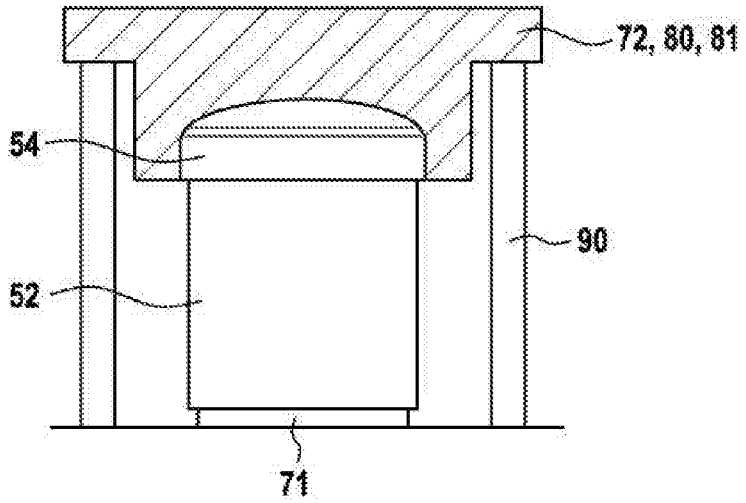
FIG. 4 shows an arrangement for carrying out the production method according to the disclosure.

The CDPF weld seam between the metallic cover element and the metallic pump housing 52 is produced, as illustrated schematically in FIGS. 3 and 4, for example as follows: in a first process step 101, the metallic pump housing 52 is placed onto a bottom electrode 71 and brought electrically into contact therewith. In a second process step 102, the metallic cover element 54 is accommodated in a collet chuck 80 with its open side downward and is gripped and brought into electrical contact therewith. In a third process step 103, the open side of the cover element 54 is brought into contact with the upper side of the pump housing 52. The inside diameter of the cover element 54 has a slight excess size of, for example, 0.5 mm in relation to the outside diameter of the pump housing 52. The cover element 54 is therefore automatically centered on the pump housing. The actual welding process then starts: in a fourth process step 104, the cover element 54 is pressed here onto the pump housing 52 with great force. After a build-up of force, a high current is conducted into the cover element 54 via the collet chuck 80, said current flowing via the contact point into the pump housing 52 and emerging again at the bottom electrode 71. The collet chuck 80 in this respect at the same time also constitutes an electrode 70 of the CDPF welding process. By means of the high transition resistance at the contact point of cover element 54 and pump housing 52, the two components melt and are connected in an integrally bonded manner as they solidify. Sinking of the cover element 54 relative to the pump housing 52 occurs in the process. The sinking is limited by a separate mechanical stop 90 against which the collet chuck 80 comes into contact after a defined sinking distance. In a subsequent process step 105, the pump is taken out of the welding device. It can optionally be provided that a sinking distance and/or a current profile is/are recorded during the process, and that the sinking distance and/or the current profile is/are compared with predetermined reference data, obtained, for example, in preliminary tests, and that it is determined on the basis of the comparison whether the process has taken place in a defective or error-free manner.

As an alternative to the use of the mechanical stop 90, the sinking of the collet chuck or of the electrode can be detected by means of other suitable sensor arrangements, for example travel sensors, and the pressing is ended after a predetermined sinking distance. There is then likewise no further sinking.

Figure 5:
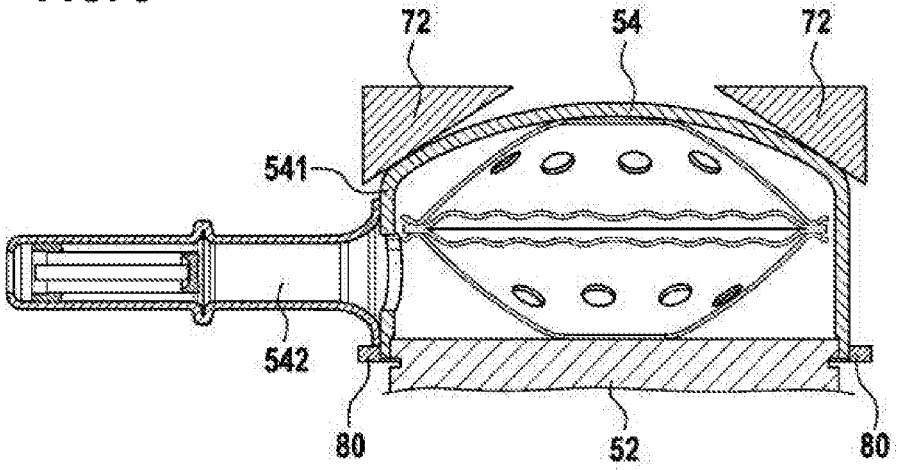
FIG. 5 shows an alternative arrangement for carrying out the production method according to the disclosure.

In an alternative embodiment, see FIG. 5, the cover element 54 has, on its radial outer wall 541, a fluid connection 542 in the form of a connecting branch. This variant requires an adapted tool concept. The introduction of the pressing force and of the current takes place here again via an electrode 70 which sits on the cover upper side, but does not completely engage around the cover as in the previous example. Instead, the cover element 54 is held on the radial outer wall 541 of the cover element 54 via a separate collet chuck 80 below the connecting branch in order to prevent the cover from yielding outward during the welding process.

The invention claimed is:

1. A method for producing a high-pressure fuel pump including a pump housing and a cup-shaped cover element, the pump housing and the cover element connected to each other by an encircling weld seam, the method comprising:
   - bringing the pump housing into contact with a bottom electrode;
   - gripping the cup-shaped cover element with a collet chuck;
   - contacting the cup-shaped cover element with another electrode;
   - bringing an open side of the cup-shaped cover element into contact with a first side of the pump housing which lies above and opposite the bottom electrode;
   - centering the cup-shaped cover element on the first side of the pump housing which lies opposite the bottom electrode;
   - pressing the cup-shaped cover element onto the pump housing in a direction of the bottom electrode; and
   - introducing an electrical current from the other electrode via the cup-shaped cover element and the pump housing into the bottom electrode with the collet chuck positioned at least partially lower than the first side, such that melting occurs at a contact point between the cup-shaped cover element and the pump housing and then the cup-shaped cover element is connected to the pump housing in an integrally bonded manner.

2. The method for producing a high-pressure fuel pump as claimed in claim 1, further comprising:
   - pressing the cup-shaped cover element onto the pump housing by introducing a force into the cup-shaped cover element with the other electrode.

3. The method for producing a high-pressure fuel pump as claimed in claim 1, wherein the collet chuck and the other electrode are configured as a single tool.

4. The method for producing a high-pressure fuel pump as claimed in claim 3, further comprising:
   - accommodating the cup-shaped cover element in the single tool,
   - wherein the single tool simultaneously realizes the collet chuck and the other electrode during the gripping and the making contact.

5. The method for producing a high-pressure fuel pump as claimed in claim 1, wherein the cup-shaped cover element includes a fluid connection on a radial outer wall and the method further comprises:
   - gripping the cup-shaped cover element with the collet chuck on a second side of the fluid connection facing the pump housing while the other electrode contacts with the cup-shaped cover element on a third side of the fluid connection facing away from the pump housing.

6. The method for producing a high-pressure fuel pump as claimed in claim 1, wherein an inside diameter of the cup-shaped cover element is greater than an outside diameter of the pump housing.

7. The method for producing a high-pressure fuel pump as claimed in claim 1, wherein, during the pressing of the cup-shaped cover element onto the pump housing in the direction of the bottom electrode and/or during the introduction of the electrical current from the other electrode via the cup-shaped cover element and the pump housing into the bottom electrode, a relative movement between the cup-shaped cover element and the pump housing onto each other occurs.

8. The method for producing a high-pressure fuel pump as claimed in claim 7, further comprising:

limiting the relative movement by a separate mechanical stop, such that the collet chuck and/or the other electrode come into contact against the separate mechanical stop while sinking.

9. The method for producing a high-pressure fuel pump as claimed in claim 1, further comprising:

detecting at least one process feature while the method is carried out;

comparing the at least one process feature with predetermined reference data; and determining on the basis of the comparison whether the method has been carried out in a defective or an error-free manner.

10. The method for producing a high-pressure fuel pump as claimed in claim 9, wherein the at least one process feature is a relative movement between the cup-shaped cover element and the pump housing and/or a strength of the electrical current flowing from the other electrode to the bottom electrode.

11. A method for producing a high-pressure fuel pump including a pump housing and a cup-shaped cover element including a fluid connection on a radial outer wall, the pump housing and the cover element connected to each other by an encircling weld seam, the method comprising:

bringing the pump housing into contact with a bottom electrode with a first side of the pump housing lying opposite the bottom electrode;

gripping with a collet chuck the cup-shaped cover element, including the fluid connection on the radial outer wall, on a second side of the fluid connection facing the pump housing while the other electrode contacts with the cup-shaped cover element on a third side of the fluid connection facing away from the pump housing;

contacting the cup-shaped cover element with another electrode;

bringing an open side of the cup-shaped cover element into contact;

centering the cup-shaped cover element on the first side of the pump housing which lies opposite the bottom electrode;

pressing the cup-shaped cover element onto the pump housing in a direction of the bottom electrode; and introducing an electrical current from the other electrode via the cup-shaped cover element and the pump housing into the bottom electrode, such that melting occurs at a contact point between the cup-shaped cover element and the pump housing and then the cup-shaped cover element is connected to the pump housing in an integrally bonded manner.

12. A method for producing a high-pressure fuel pump including a pump housing and a cup-shaped cover element, the pump housing and the cover element connected to each other by an encircling weld seam, the method comprising:

bringing the pump housing into contact with a bottom electrode;

gripping the cup-shaped cover element with a collet chuck;

contacting the cup-shaped cover element with another electrode;

bringing an open side of the cup-shaped cover element into contact with a first side of the pump housing which lies opposite the bottom electrode;

centering the cup-shaped cover element on the first side of the pump housing which lies opposite the bottom electrode;

pressing the cup-shaped cover element onto the pump housing in a direction of the bottom electrode; and introducing an electrical current from the other electrode via the cup-shaped cover element and the pump housing into the bottom electrode, such that melting occurs at a contact point between the cup-shaped cover element and the pump housing and then the cup-shaped cover element is connected to the pump housing in an integrally bonded manner, wherein, during the pressing of the cup-shaped cover element onto the pump housing in the direction of the bottom electrode and/or during the introduction of the electrical current from the other electrode via the cup-shaped cover element and the pump housing into the bottom electrode, a relative movement between the cup-shaped cover element and the pump housing onto each other occurs, and the method further includes limiting the relative movement between the cup-shaped cover element and the pump housing by a separate mechanical stop, such that the collet chuck and/or the other electrode come into contact against the separate mechanical stop while sinking.

* * * * *